US005409758A

United States Patent [19]

Hiyoshi et al.

[11] Patent Number: 5,409,758

[45] Date of Patent: Apr. 25, 1995

[54] THERMAL IMAGE TRANSFER RECORDING MEDIUM

[75] Inventors: Yoshihiko Hiyoshi, Shizuoka; Yohji Ide, Mishima; Keiichi Shiokawa, Numazu; Masahiro Sato, Shizuoka, all of Japan

[73] Assignee: Ricoh Company, Ltd., Tokyo, Japan

[21] Appl. No.: 139,165

[22] Filed: Oct. 21, 1993

[30] Foreign Application Priority Data

Oct. 23, 1992 [JP] Japan ..... 4-309686
Nov. 4, 1992 [JP] Japan ..... 4-319318

[51] Int. Cl.[6] ..... B41M 5/26

[52] U.S. Cl. ..... 428/138; 428/195; 428/318.4; 428/341; 428/412; 428/480; 428/484; 428/488.4; 428/500; 428/522; 428/532; 428/913; 428/914

[58] Field of Search ..... 428/195, 488.4, 484, 428/141, 173, 913, 914, 138, 318.4, 341, 412, 480, 500, 522, 532

[56] References Cited

U.S. PATENT DOCUMENTS

| | | | |
|---|---|---|---|
| 4,529,993 | 7/1985 | Watanabe et al. | 346/208 |
| 4,627,997 | 12/1986 | Ide | 428/216 |
| 4,983,444 | 1/1991 | Ide et al. | 428/195 |
| 5,053,267 | 10/1991 | Ide et al. | 428/195 |
| 5,087,527 | 2/1992 | Shimura et al. | 428/488.4 |
| 5,110,389 | 5/1992 | Hiyoshi et al. | 156/234 |
| 5,134,019 | 7/1992 | Shiokawa et al. | 428/212 |
| 5,179,388 | 1/1993 | Shiokawa et al. | 346/1.1 |
| 5,183,697 | 2/1993 | Ide et al. | 428/195 |
| 5,229,189 | 7/1993 | Hiyoshi et al. | 428/195 |
| 5,238,726 | 8/1993 | Ide et al. | 428/195 |
| 5,250,346 | 10/1993 | Nagai et al. | 428/195 |
| 5,250,361 | 10/1993 | Ide et al. | 428/500 |
| 5,258,234 | 11/1993 | Ide et al. | 428/500 |

*Primary Examiner*—Pamela R. Schwartz
*Attorney, Agent, or Firm*—Oblon, Spivak, McClelland, Maier & Neustadt

[57] ABSTRACT

A thermal image transfer recording medium composed of a support, a thermofusible ink layer formed thereon, which contains as the main components a thermofusible material and a coloring agent, and a resin layer formed on the thermofusible ink layer, which has a structure with minute craters thereon.

9 Claims, 4 Drawing Sheets

THERMAL IMAGE TRANSFER RECORDING MEDIUM

BACKGROUND OF THE INVENTION

1. Field of the Invention

The present invention relates to a thermal image transfer recording medium comprising a support, and a thermofusible ink layer and a resin layer with a specific structure, successively formed on the support, capable of producing images with high density when it is used repeatedly.

2. Discussion of Background

Recording apparatus such as a printer and a facsimile apparatus to which the thermal image transfer recording method is applied have been widespread. This is because the recording apparatus of this type are relatively small in size and can be produced inexpensively, and their maintenance is simple.

In a conventional thermal image transfer recording medium for use with the thermal image transfer recording apparatus, a single thermofusible ink layer is merely formed on a support. When such a recording medium is used for printing images, those portions of the ink layer heated by a thermal head completely transfer to an image receiving sheet, such as a sheet of plain paper, at only one-time printing. Therefore, the recording medium can be used only once, and can never be used repeatedly. Such a conventional thermal image transfer recording medium is disadvantageous from the viewpoint of running cost.

There is an increasing demand for a thermal image transfer recording medium which can be used repeatedly, and many kinds of multi-printing type thermal image transfer recording media have been proposed as shown below:

(1) As disclosed in Japanese Laid-Open Patent Applications 54-68253, 55-105579 and 60-40293, there is proposed a thermal image transfer recording medium comprising a support and a microporous ink layer formed thereon, with a thermofusible ink impregnated in the microporous ink layer gradually oozing out.

(2) As disclosed in Japanese Laid-Open Patent Application 58-212993, there is proposed a thermal image transfer recording medium comprising a support, and an ink layer and a porous layer successively provided on the support, with the amount of the ink which oozes out from the ink layer being controlled.

(3) As disclosed in Japanese Laid-Open Patent Applications 60-127191 and 60-127192, there is proposed a thermal image transfer recording medium comprising a plurality of ink layers and a plurality of adhesive layers, each ink layer alternating with each adhesive layer. In this thermal image transfer recording medium, a pair of the ink layer and the adhesive layer can be gradually exfoliated as the images are printed, thereby always exposing an unused ink layer for the printing operation.

However, the above-mentioned thermal image transfer recording media have their own shortcomings.

For example, when the thermal image transfer recording medium (1) is used, the amount of the ink oozing out from the ink layer becomes insufficient after the repeated use of the recording medium. As a result, the image density of printed images gradually decreases as the number of printing times increases.

Regarding the thermal image transfer recording medium (2), the mechanical strength of the porous layer is decreased when the size of the pore included therein is increased to upgrade the image density, and thus the ink layer is apt to peel off the support together with the porous layer.

As for the thermal image transfer recording medium (3), the amount of the thermofusible ink transferred from the recording medium is not constant every time images are printed using the recording medium.

Furthermore, most of the conventional thermal image transfer recording media have been developed for a serial thermal head for use in a recording apparatus such as a word processor. Therefore, when those recording media are applied to a line thermal head for use in a recording apparatus such as a facsimile apparatus or a bar code printer, some troubles are produced, for instance, exfoliation of the ink layer, and decrease in image density of the printed images. This is because it takes long until the thermal image transfer recording medium is separated from the image receiving sheet from the time when thermal energy is applied to the thermal image transfer recording medium coming into contact with the image receiving sheet.

As disclosed in Japanese Laid-Open Patent Application 63-137891, the exfoliation of the ink layer from the support can be prevented by providing an intermediate adhesive layer comprising a heat-softening resin between the support and the ink layer in the thermal image transfer recording medium (1) or (2). In this case, however, the thermal loss is large during the thermal printing operation because of the provision of the intermediate adhesive layer. The thickness of the ink layer of the thermal image transfer recording medium capable of achieving the multi-printing operation is originally larger than that of the one-time thermal image transfer recording medium. Therefore the thermal sensitivity is remarkably decreased when the intermediate adhesive layer is provided in the multi-printing thermal image transfer recording medium. To overcome the above drawback, it is necessary to decrease the amount of the ink contained in the ink layer or increase the thermal energy applied to the recording medium.

SUMMARY OF THE INVENTION

Accordingly, an object of the present invention is to provide a thermal image transfer recording medium free from the problem of peeling of an ink layer from a support, which can continue to yield sharp images with high density, with little decrease of the image density during the repeated thermal printing operations even though the thermal energy applied to the recording medium is not increased.

The above-mentioned object of the present invention can be achieved by a thermal image transfer recording medium comprising a support, a thermofusible ink layer formed thereon, which comprises as the main components a thermofusible material and a coloring agent, and a resin layer formed on the thermofusible ink layer, which has a structure with minute craters thereon.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Referring now to the accompanying drawings, the present invention will be explained in detail.

Figure 1:
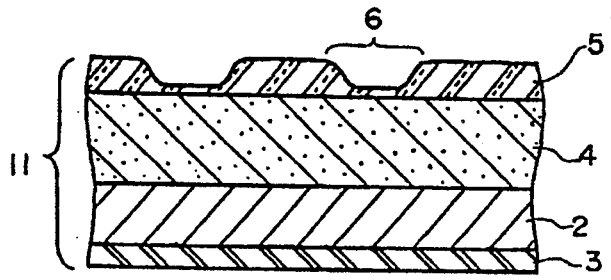
FIGS. 1 through 3 are schematic cross-sectional views in explanation of one embodiment of a thermal image transfer recording medium according to the present invention.

FIG. 1 is a cross-sectional view of a first embodiment of a thermal image transfer recording medium according to the present invention. As shown in FIG. 1, a thermal image transfer recording medium 11 comprises a support 2, a thermofusible ink layer 4 formed on the support 2, and a resin layer 5 formed on the ink layer 4, which has a structure with minute craters 6 thereon. In addition, a heat-resistant protective layer 3 may be provided on the back surface of the support 2, opposite to the ink layer 4 with respect to the support 2, as shown in FIG. 1.

In the thermal image transfer recording medium 11 shown in FIG. 1, the resin layer 5 is provided on the ink layer 4 to prevent the peeling of the ink layer 4 from the support 2, and the minute craters 6 are formed in the resin layer 5 for the purpose of controlling the amount of the ink oozing out from the ink layer 4 when thermal image transfer is carried out.

Any conventional thermoplastic resins can be employed for the resin layer 5, and in particular, vinyl chloride—vinyl acetate copolymer, polyester resin, polycarbonate resin and cellulose resin are preferred in the present invention.

To form a structure with the minute craters 6 in the resin layer 5, any of the above-mentioned thermoplastic resins is dissolved in a volatile solvent such as methyl ethyl ketone to prepare a resin solution. The resin solution thus prepared is coated on the ink layer 4 by the conventional coating methods using a wire bar and a gravure coater, and then dried in the atmosphere of 30 to 90 percent relative humidity.

In the case where the craters 6 are formed in the resin layer 5 as shown in FIG. 1, it is preferable that each of the craters 6 have a diameter of 0.01 to 10 $\mu$m, and the number of craters 6 be in the range from 30 to 300 per 400 $\mu m^2$ on the resin layer 5. When the craters 6 each having a diameter of 0.01 to 10 $\mu$m are provided at a density of as many as 30 to 300 per 400 $\mu m^2$ on the resin layer 5, the ink can appropriately ooze from the ink layer 4, so that the thermal image transfer recording medium can repeatedly be used with high image density of the printed images being maintained. The diameter of each crater and the number of craters formed in the resin layer 5 can be controlled by adjusting the relative humidity of the air, and in addition, the flow rate and the flow velocity of the air at the drying process in the formation of the resin layer 5 on the ink layer 4.

It is preferable that the coating amount of the thermoplastic resin for use in the resin layer 5 is in the range from 0.02 to 0.50 g/m$^2$. When the coating amount of the resin is within the above-mentioned range, the resin layer 5 has such a sufficient mechanical strength that the peeling of the ink layer 4 from the support 2 can be prevented. In addition to this, the thermal sensitivity of the recording medium 11 is not decreased, so that sharp images can be produced with high image density.

In the present invention, a plurality of holes passing through the resin layer 5 and penetrating to the surface of the ink layer 4 (hereinafter referred to as penetrating holes) may be formed in the resin layer 5.

Figure 2:
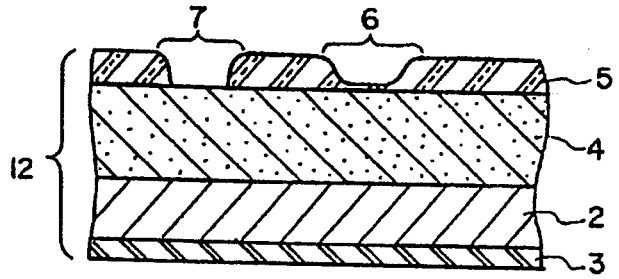

In a thermal image transfer recording medium 12 as shown in FIG. 2, not only craters 6, but also penetrating holes 7 are formed in a resin layer 5. By such a configuration as shown in FIG. 2, sharp images with high image density can be produced while the thermal image transfer recording medium 12 is repeatedly used. More specifically, when the thermal energy is applied to the recording medium 11 shown in FIG. 1, the craters are broken and the ink contained in the ink layer 4 is supplied to an image receiving medium. In the case of the thermal image transfer recording medium 12 shown in FIG. 2, the ink contained in the ink layer 4 can be supplied to an image receiving medium through the penetrating holes 7 even if the thermal energy applied to the recording medium 12 is as small as not to break the craters 6. Accordingly, the thermal image transfer recording medium 12 is capable of yielding sharp images with high image density during the repeated thermal printing operations even if the applied thermal energy is small.

The penetrating holes 7 can be formed in the resin layer 5 in the same manner as that in the formation of the minute craters as previously mentioned. For example, in the course of the preparation of a coating liquid for the resin layer 5, water or alcohols such as methanol and ethanol may be added to a solution of the thermoplastic resin for use in the resin layer 5. Further, the relative humidity of the air may be controlled to in the range from 40 to 80% while the resin layer coating liquid is dried after it is coated on the ink layer 4.

In the case where both the penetrating holes 7 and the craters 6 are formed in the resin layer 5 as shown in FIG. 2, it is preferable that each of the craters have a diameter of 0.01 to 10 $\mu$m, and the number of craters be in the range from 30 to 300 per 400 $\mu m^2$ on the resin layer 5. Furthermore, the proper diameter of each penetrating hole 7 is in the range from 0.1 to 3.0 $\mu$m, and the number of penetrating holes 7 is preferably in the range from 10 to 150 per 400 $\mu m^2$ on the resin layer 5.

The resin layer 5 may further comprise a releasing agent to permit the thermal image transfer recording medium of the present invention to release more easily from the image receiving medium after completion of the thermal image transfer operation.

Figure 3:
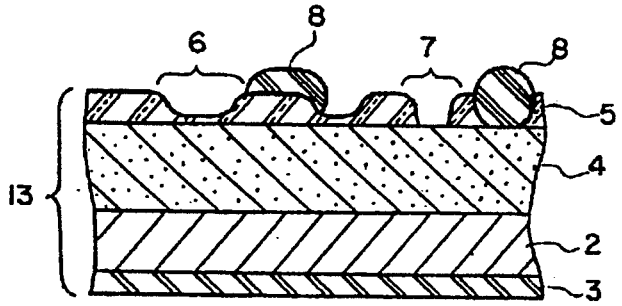

In a thermal image transfer recording medium 13 as shown in FIG. 3, craters 6 and penetrating holes 7 are formed in a resin layer 5, and a releasing agent 8 is contained in the resin layer 5 or deposited in the form of granules thereon.

The resin layer 5 may comprise the releasing agent 8 as a matter of course in the thermal image transfer recording medium 11 in which only the craters 6 are formed in the resin layer 5.

Owing to the releasing agent 8 contained in the resin layer 5 or deposited thereon, the adhesion of a softened part of the thermoplastic resin for use in the resin layer 5 to the image receiving medium can be prevented, and the complete transfer of the ink layer 6 to the image receiving medium can be prevented even when the thermal energy applied to the recording medium 13 from a thermal head is very large, or the thermal printing speed is very slow.

Conventional organic and inorganic lubricants are preferably employed as the releasing agents 8. Specific examples of the releasing agent 8 for use in the resin layer 5 are natural waxes, petroleum waxes and synthetic waxes, such as beeswax, carnauba wax, whale wax, Japan wax, candelilla wax, rice bran wax, montan wax, paraffin wax, polyethylene wax, oxidized wax, ozocerite, ceresine wax and ester wax; higher fatty acids such as margaric acid, lauric acid, myristic acid, palmitic acid, stearic acid, fromic acid and behenic acid; higher alcohols such as stearyl alcohol and behenyl alcohol; higher amides such as stearic amide and oleic amide; esters such as fatty acid esters of glycerin and sorbitan; inorganic pigments such as silica, calcium carbonate, talc and kaolin; and organic fillers such as finely-divided particles of fluorine-containing resin and vinyl chloride.

In particular, the releasing agent 8 comprising a wax as the main component is preferable in the present invention. This is because that a part of the wax component which is disposed in the surface portion of the releasing agent 8 and comes in contact with the image receiving medium is fused when the thermal energy is applied to the recording medium 13 from a thermal head. Therefore the resin layer 5 of the thermal image transfer recording medium 13 can be brought into contact with the image receiving medium more closely. As a result, the images thermally transferred from the recording medium 13 to the image receiving medium show high resolution. Another advantage of the releasing agent comprising the wax component is that the releasing agent 8 is solidified and functions as a spacer between the thermal image receiving medium 13 and the image receiving medium when the thermal image transfer recording medium 13 is separated from the image receiving medium after the completion of the thermal image transfer operation. Therefore, the complete transfer of the ink layer 4 to the image receiving medium can be prevented.

It is preferable that the penetration of the wax for use in the releasing agent 8 is 2 or less at 25° C. By using such a releasing agent 8, the migration of the resin layer 5, for example, when a plurality of thermal image transfer recording media are superimposed in such a fashion that the resin layer of a lower recording medium is brought into contact with the back surface of an upper recording medium. Namely, the blocking phenomenon can effectively be prevented.

It is preferable that the releasing agent 8 be contained in the resin layer 5 or deposited thereon in the form of granules with a diameter of 0.1 to 20 μm, more preferably 3 to 10 μm. When the granules of the releasing agent 8 are of the aforementioned size, the releasing agent 8 can effectively function as the spacer between the thermal image transfer recording medium 13 and the image receiving medium, so that the complete transfer of the ink layer 4 to the image receiving medium can be prevented. In addition, the close contact between the image receiving medium and the thermal image transfer recording medium 13 can be maintained, thereby preventing the decrease of resolution of the obtained images.

As previously explained, the thermal image transfer recording medium 13 can release easily from the image receiving medium and the complete transfer of the ink layer 4 to the image receiving medium can be prevented because the releasing agent 8 is deposited on the resin layer 5. To prevent the complete transfer of the ink layer 4 to the image receiving medium more certainly, it is recommended to impart the adhesive properties with respect to the support 2 to the ink layer 4. More specifically, the ink layer 4 may comprise an agent capable of showing good adhesion to the support 2. For example, a polymeric adhesive such as ethylene—vinyl acetate copolymer and a wax such as microcrystalline wax are preferably employed as the adhesives for use in the ink layer 4.

The amount of the above-mentioned adhesive contained in the ink layer 4 is appropriately determined in accordance with the number of multi-printing times and the printing conditions. When the thermal image transfer recording medium is applied to a printer with a line thermal head, the amount of the polymeric adhesive is preferably in the range from 5 to 50 wt. % of the total weight of the ink layer 4. In the case where the polymeric adhesive is contained in the ink layer 4 at the above-mentioned concentration, the decrease in image density of the transferred images can be prevented and the adhesive properties of the ink layer 4 to the support 2 are sufficient. When the microcrystalline wax is contained in the ink layer 4, the amount of the microcrystalline wax is preferably in the range from 5 to 70 wt. % of the total weight of the ink layer 4. When the amount of the microcrystalline wax is within the above range, the adhesive properties of the ink layer 4 to the support 2 can be improved, and there is no problem of the blocking phenomenon.

Figure 4:
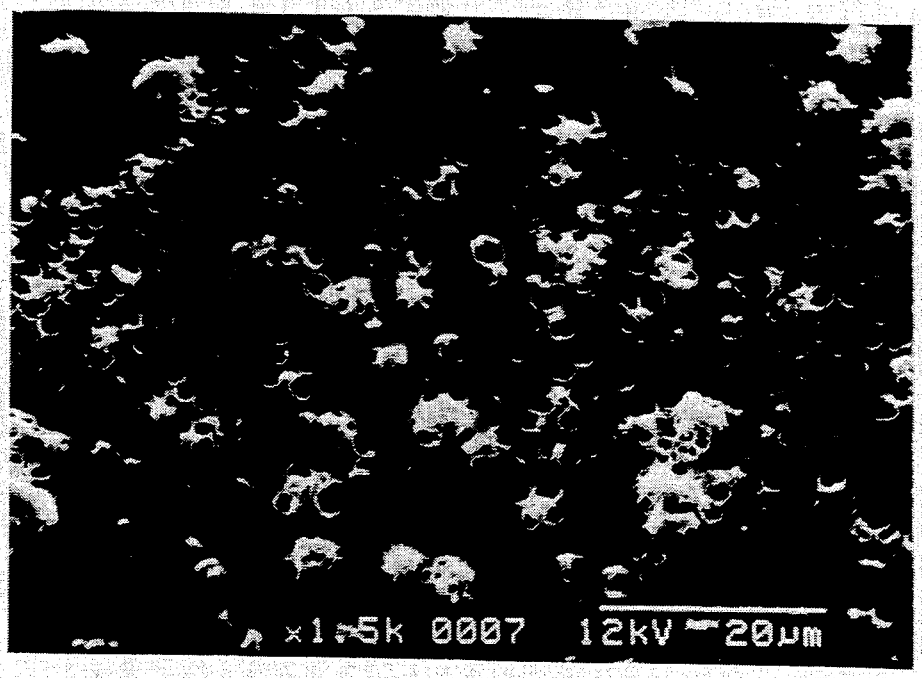
FIG. 4 is an electron microscope photograph which shows a cross section of the thermal image transfer recording medium as shown in FIG. 3.

FIG. 4 is an electron microscope photograph showing the surface profile of the thermal image transfer recording medium 13 shown in FIG. 3. In the photograph shown in FIG. 4, ring-shaped white portions indicate the minute craters 6 formed in the resin layer 5 and white portions which are irregular in shape indicate the releasing agent 8 deposited in the form of granules on the resin layer 5.

Figure 5:
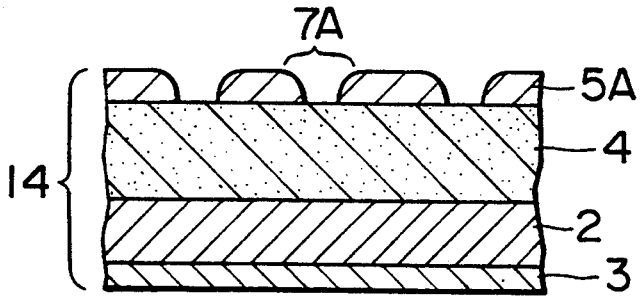
FIGS. 5 and 6 are schematic cross-sectional views in explanation of another embodiment of a thermal image transfer recording medium according to the present invention.

FIG. 5 is a cross-sectional view of another embodiment of the thermal image transfer recording medium according to the present invention.

In a thermal image transfer recording medium 14 as shown in FIG. 5, a thermofusible ink layer 4 and a resin layer 5A with a network structure are successively formed on a support 2. In this embodiment shown in FIG. 5, a plurality of cylindrical holes 7A are formed among the network structure of the resin layer 5A, with passing through the resin layer 5A in a direction substantially perpendicular to the resin layer 5A, and penetrating to the surface of the thermofusible ink layer 4.

To form such a network structure of the resin layer 5A with the penetrating holes 7A, the same thermoplastic resins as described in the formation of the resin layer 5 with the craters 6 with reference to the first embodiment shown in FIG. 1 can be employed. The thermoplastic resin may be dissolved in a volatile solvent such as methyl ethyl ketone to prepare a resin solution. When necessary, water or alcohols such as methanol and ethanol may be added to the resin solution. The resin solution thus prepared is coated on the ink layer 4 by the conventional coating methods using a wire bar and a gravure coater, and then dried in the atmosphere of 50%RH or more, preferably in the range from 60 to 80%RH.

It is preferable that the diameter of each penetrating hole 7A formed in the resin layer 5A be in the range from 0.01 to 10 μm, more preferably in the range from 0.1 to 3.0 μm when the controllability of the amount of the ink oozing from the ink layer 4 is taken into consideration.

Furthermore, the penetrating holes 7A may be disposed on the resin layer 5A at intervals of 10 μm or less, preferably at intervals of 0.5 to 2.0 μm. When the distance between the adjacent penetrating holes 7A is within the above range, the inks oozing from the ink layer 4 through the adjacent penetrating holes 7A can be joined together when a solid black area is formed on the image receiving medium, so that the solid black area without white non-printed spots can be obtained.

It is preferable that the number of penetrating holes 7A be in the range from 30 to 300, more preferably in the range from 50 to 150 per 400 $\mu m^2$ on the resin layer 5A. When the penetrating holes 7A are provided at the above-mentioned density on the resin layer 5A, the ink can appropriately ooze from the ink layer 4, so that the thermal image transfer recording medium 14 can repeatedly be used with high image density of the printed images being maintained.

The diameter of each penetrating hole 7A, the distance between the adjacent penetrating holes 7A, and the number of penetrating holes 7A formed in the resin layer 5A can be controlled by adjusting the relative humidity of the air at the drying process in the formation of the resin layer 5A. Further, the above-mentioned control of the configuration of the penetrating holes 7A can be facilitated by adjusting the amount of water and an alcohol to be added to the resin solution of the resin layer coating liquid.

The coating amount of the coating liquid for the resin layer 5A is preferably in the range from 0.02 to 0.50 $g/m^2$ on a dry basis.

Figure 6:
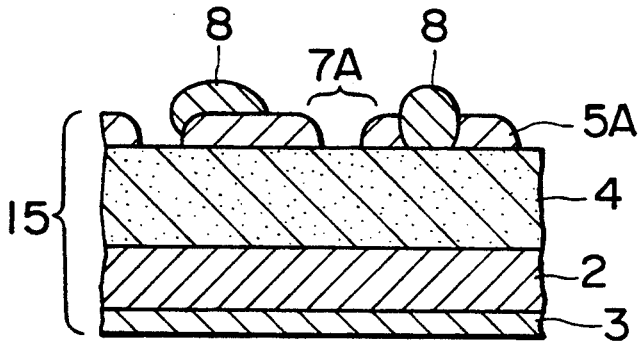

As shown in FIG. 6, a resin layer 5A of a thermal image transfer recording medium 15 may further comprise a releasing agent 8, which is contained in the resin layer 5A or deposited in the form of granules thereon.

It is preferable that the releasing agent 8 for use in the resin layer 5A comprise a wax as the main component. In addition, the penetration of a wax for use in the releasing agent 8 is preferably 2 or less at 25° C.

Figure 7:
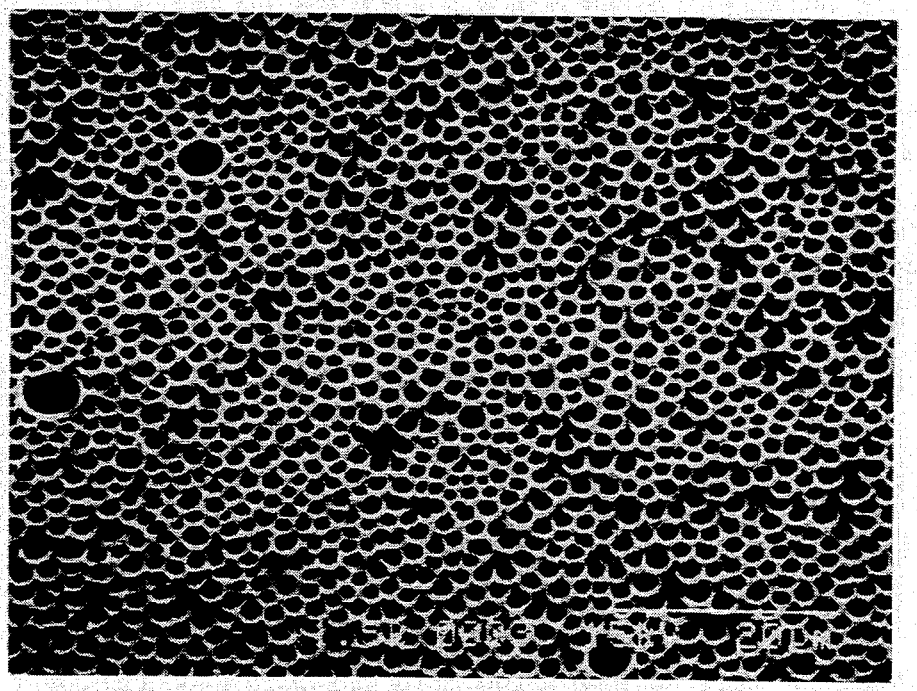
FIG. 7 is an electron microscope photograph which shows a cross section of the thermal image transfer recording medium as shown in FIG. 5.
Figure 8:
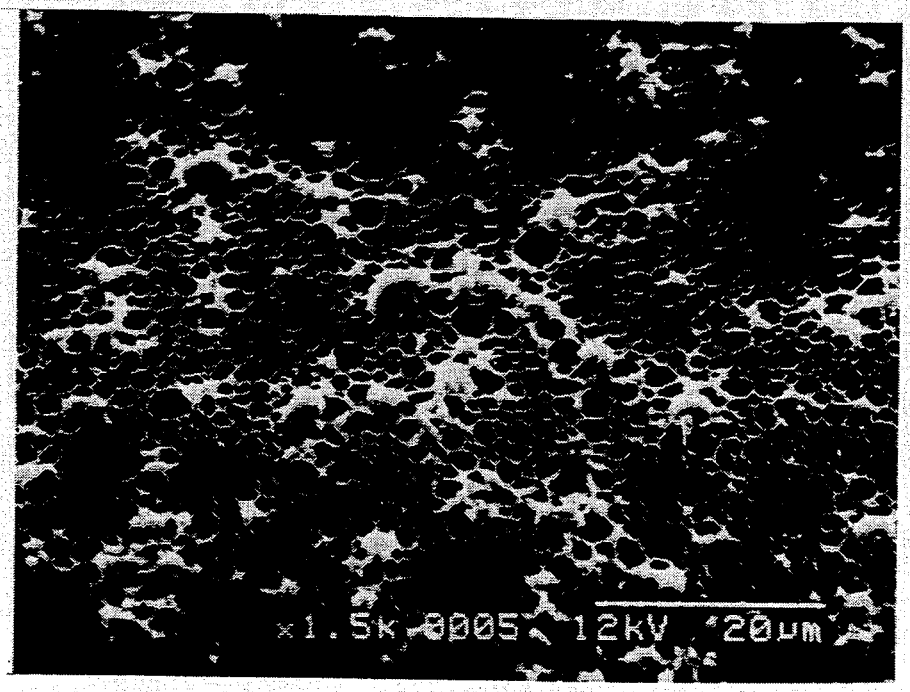
FIG. 8 is an electron microscope photograph which shows a cross section of the thermal image transfer recording medium as shown in FIG. 6.

FIGS. 7 and 8 are electron microscope photographs which show cross sections of the thermal image transfer recording media of FIG. 5 and FIG. 6, respectively.

To maintain the high image density of the printed images in the course of repeated thermal printing operations, a plurality of thermofusible ink layers 4 may be provided on a support 2 with a gradient of the melt viscosity of the thermofusible inks contained in the ink layers in such a fashion that the closer to the support 2, the higher the melt viscosity of the thermofusible ink.

In this case, the melt viscosity of the thermofusible ink in each ink layer can be controlled by appropriately selecting the kind of thickening agent and determining the amount thereof, and adding it to the ink layer 4. Any adhesive material which is a solid at room temperature can be used as the thickening agent. Examples of the thickening agent for use in the ink layers include a variety of polymeric materials and organic materials with a high melt viscosity such as microcrystalline wax. One of the thickening agents preferably employed in the present invention is ethylene—vinyl acetate copolymer, particularly with a melt flow rate of not less than 10 g/10 min, preferably not less than 100 g/10 min, as defined in the Japanese Industrial Standards K-6760.

The thermal image transfer recording medium of the present invention can be fabricated by the conventional method. The thermofusible ink layer 4 is provided on the support 2, and the resin layer 5 is formed on the ink layer 4 in accordance with the previously mentioned methods. A single thermofusible ink layer 4 may be provided on the support 2, or a plurality of ink layers 4 may be formed thereon with the melt viscosity of the thermofusible inks in the ink layers 4 being increased toward the support 2.

The thermofusible ink layer 4 of the thermal image transfer recording medium comprises as the main components a coloring agent and a thermofusible material.

The coloring agent for use in the ink layer 4 can appropriately be selected from the conventional pigments such as carbon black and phthalocyanine pigments, and the conventional dyes such as direct dyes, acid dyes, basic dyes, disperse dyes and oil-soluble dyes.

Examples of the thermofusible material serving as a vehicle of the ink layer 4 include natural waxes such as beeswax, carnauba wax, whale wax, Japan wax, candelilla wax, rice bran wax and montan wax; other waxes such as paraffin wax, polyethylene wax, oxidized wax, ozocerite, ceresine wax and ester wax; higher fatty acids such as margaric acid, lauric acid, myristic acid, palmitic acid, stearic acid, fromic acid and behenic acid; higher alcohols such as stearyl alcohol and behenyl alcohol; higher amides such as stearic amide and oleic amide; and esters such as fatty acid esters of glycerin and sorbitan.

The amount of a coating liquid for the thermofusible ink layer 4 may appropriately be determined with the predetermined number of multi-printing times and the thermal sensitivity to be imparted to the recording medium being taken into consideration. It is preferable that the coating amount of the thermofusible ink layer 4 be about 4 to 12 $g/m^2$ on a dry basis. In the case where a plurality of thermofusible ink layers 4 are formed on the support 2, the amount of the coating liquid for each ink layer 4 is preferably about 2 to 7 $g/m^2$, and about 2 to 5 $g/m^2$ on a dry basis, respectively in the formation of two ink layers, and three ink layers.

Conventional heat-resistant materials can be used for the support 2 of the thermal image transfer recording medium according to the present invention. Examples of such a heat-resistant material include a film of plastics such as polyester, polycarbonate, triacetyl cellulose, nylon and polyimide, and a sheet of cellophane, parchment paper or condenser paper. The thickness of the support 2 is preferably in the range from about 2 to 15 μm from the viewpoints of thermosensitivity and mechanical strength of the recording medium.

As shown in FIGS. 1, 2, 3, 5 and 6, it is possible to improve the heat resistance of the support 2 by providing a heat-resistant protective layer 3 on the back side of the support 2, which side is brought into contact with a thermal head. Examples of the material for the heat-resistant protective layer 3 are silicone resin, fluorine-containing resin, polyimide resin, epoxy resin, phenolic resin, melamine resin and nitrocellulose. The proper thickness of the heat-resistant protective layer 3 is in the range from about 0.01 to 2.0 μm.

Other features of this invention will become apparent in the course of the following description of exemplary embodiments, which are given for illustration of the invention and are not intended to be limiting thereof.

Example 1-1

Formation of Thermofusible Ink Layers A and B

The following components were thoroughly dispersed in a sand mill vessel at 110° C. to prepare a coating liquid for a thermofusible ink layer A:

| | Parts by weight |
|---|---|
| Carbon black | 15 |
| Hydrous lanolin fatty acid monoglyceride (m.p. = 73° C.) | 25 |
| Candelilla wax | 20 |
| Microcrystalline wax (m.p. = 83° C.) | 30 |
| Ethylene-vinyl acetate copolymer (melt flow rate: 2,500 g/10 min) | 10 |

The thus prepared coating liquid for the thermofusible ink layer A was coated by hot-melt coating on one side of an about 5.5 μm thick polyethylene terephthalate film (hereinafter referred to as a PET film) serving as a support in a deposition amount of about 3 g/m$^2$ on a dry basis, the other side of which PET film has been subjected to heat-resistant treatment. Thus, a thermofusible ink layer A was provided on the support.

The following components were thoroughly dispersed in a sand mill vessel at 110° C.:

| | Parts by weight |
|---|---|
| Carbon black | 10 |
| Candelilla wax | 40 |
| Hydrous lanolin fatty acid monoglyceride (m.p. = 73° C.) | 50 |

Twenty parts by weight of the above prepared dispersion were pulverized and added to 80 parts by weight of a mixed solvent of methyl ethyl ketone and toluene with a weight ratio of 2:1. The mixture was dissolved under the application of heat thereto, and then cooled to 25° C., so that a coating dispersion for a thermofusible ink layer B was obtained.

The thus prepared coating dispersion for the thermofusible ink layer B was coated on the above prepared thermofusible ink layer A by a bar coater and then dried at 80° C., so that a thermofusible ink layer B was provided in a deposition amount of about 4 g/m$^2$ on a dry basis on the thermofusible ink layer A.

Formation of Resin Layer

Three parts by weight of cellulose acetate propionate and 97 parts by weight of methyl ethyl ketone were mixed to prepare a coating liquid for a resin layer.

The thus prepared coating liquid for the resin layer was coated on the above prepared thermofusible ink layer B by a bar coater, and then dried in such a manner that the air of 30%RH and 20° C. was uniformly applied to the resin layer coating liquid at a speed of 2 m/sec for 10 seconds. Thus, a resin layer was provided on the thermofusible ink layer B in a deposition amount of 0.2 g/m$^2$ on a dry basis.

Thus, a thermal image transfer recording medium No. 1-1 according to the present invention was obtained.

The cross section of the thermal image transfer recording medium No. 1-1 was analyzed using a transmission type electron microscope (TEM) photograph, and the surface profile thereof was analyzed by using a scanning electron microscope (SEM) photograph. It was confirmed that the resin layer formed on the thermofusible ink layer B had minute craters thereon. The diameter of each crater was about 0.05 μm, and the number of craters was about 200 per 400 μm$^2$ on the resin layer.

EXAMPLE 1-2

The procedure for the preparation of the thermal image transfer recording medium No. 1-1 in Example 1-1 was repeated except that the humidity of the air was changed from 30 to 80%RH at the drying process in the formation of the resin layer in Example 1-1, so that a thermal image transfer recording medium No. 1-2 according to the present invention was obtained.

The diameter of each crater formed in the resin layer was about 9 μm, and the number of craters was about 50 per 400 μm$^2$ on the resin layer.

EXAMPLE 1-3

The procedure for the preparation of the thermal image transfer recording medium No. 1-1 in Example 1-1 was repeated except that the humidity of the air was changed from 30 to 50%RH at the drying process in the formation of the resin layer in Example 1-1, so that a thermal image transfer recording medium No. 1-3 according to the present invention was obtained.

The diameter of each crater formed in the resin layer was about 3 μm, and the number of craters was about 100 per 400 μm$^2$ on the resin layer.

EXAMPLE 1-4

Two thermofusible ink layers A and B were provided on a support in the same manner as in Example 1-1.

The following components were mixed to prepare a coating liquid for a resin layer:

| | Parts by Weight |
|---|---|
| Cellulose acetate propionate | 3 |
| Methyl ethyl ketone | 93 |
| Methanol | 4 |

The thus prepared coating liquid for the resin layer was coated on the above prepared thermofusible ink layer B by a bar coater, and then dried in such a manner that the air of 25%RH and 10° C. was uniformly applied to the resin layer coating liquid at a speed of 2 m/sec for 10 seconds. Thus, a resin layer with minute craters was provided on the thermofusible ink layer B.

Thus, a thermal image transfer recording medium No. 1-4 according to the present invention was obtained.

The diameter of each crater formed in the resin layer was about 2 μm, and the number of craters was about 35 per 400 μm$^2$ on the resin layer.

EXAMPLE 1-5

The procedure for the preparation of the thermal image transfer recording medium No. 1-4 in Example 1-4 was repeated except that the humidity of the air was changed from 25 to 80%RH at the drying process in the formation of the resin layer in Example 1-4, so that a thermal image transfer recording medium No. 1-5 according to the present invention was obtained.

The diameter of each crater formed in the resin layer was about 6 μm, and the number of craters was about 280 per 400 $\mu m^2$ on the resin layer.

EXAMPLE 1-6

Two thermofusible ink layers A and B were provided on a support in the same manner as in Example 1-1.

The following components were mixed to prepare a coating liquid for a resin layer:

| | Parts by Weight |
|---|---|
| Cellulose acetate propionate | 3 |
| Methyl ethyl ketone | 89 |
| Methanol | 4 |
| Water | 4 |

The thus prepared coating liquid for the resin layer was coated on the above prepared thermofusible ink layer B by a bar coater, and then dried in such a manner that the air of 50%RH and 20° C. was uniformly applied to the resin layer coating liquid at a speed of 2 m/sec for 10 seconds. Thus, a resin layer with minute craters was provided on the thermofusible ink layer B.

Thus, a thermal image transfer recording medium No. 1-6 according to the present invention was obtained.

The number of craters was about 100 per 400 $\mu m^2$ on the resin layer. Furthermore, it was confirmed by the TEM photograph and the SEM photograph that holes penetrating to the surface of the thermofusible ink layer B were formed in the resin layer. The number of penetrating holes was about 20 per 400 $\mu m^2$ on the resin layer.

EXAMPLE 1-7

The procedure for the preparation of the thermal image transfer recording medium No. 1-3 in Example 1-3 was repeated except that the coating liquid for the resin layer used in Example 1-3 was replaced by a coating liquid with the following formulation:

| (Formulation for Coating Liquid for Resin Layer) | Parts by Weight |
|---|---|
| Cellulose acetate propionate | 3 |
| Vinyl chloride powder "PGR-121" (Trademark), made by Nippon Zeon Co., Ltd. | 2 |
| Methyl ethyl ketone | 95 |

Thus, a thermal image transfer recording medium No. 1-7 according to the present invention was obtained.

The diameter of each of the craters formed in the resin layer was about 2 μm, and the number of craters was about 80 per 400 $\mu m^2$ on the resin layer. Furthermore, it was confirmed by an SEM photograph that the vinyl chloride powder serving as a releasing agent deposited in the form of granules on the resin layer functioned as a spacer.

EXAMPLE 1-8

The procedure for the preparation of the thermal image transfer recording medium No. 1-3 in Example 1-3 was repeated except that the coating liquid for the resin layer used in Example 1-3 was replaced by a coating liquid with the following formulation:

| (Formulation for Coating Liquid for Resin Layer) | Parts by Weight |
|---|---|
| Cellulose acetate propionate | 3 |
| Aqueous dispersion of paraffin wax (solid content: 30 wt. %, average particle diameter: approx. 3 μm) | 8 |
| Methyl ethyl ketone | 89 |

Thus, a thermal image transfer recording medium No. 1-8 according to the present invention was obtained.

The diameter of each of the craters formed in the resin layer was about 3 μm, and the number of craters was 100 per 400 $\mu m^2$.

EXAMPLE 1-9

The procedure for the preparation of the thermal image transfer recording medium No. 1-3 in Example 1-3 was repeated except that the coating liquid for the resin layer used in Example 1-3 was replaced by a coating liquid with the following formulation:

| (Formulation for Coating Liquid for Resin Layer) | Parts by Weight |
|---|---|
| Cellulose acetate propionate | 3 |
| Aqueous dispersion of carnauba wax (solid content: 30 wt. %, average particle diameter: approx. 4 μm) | 8 |
| Methyl ethyl ketone | 89 |

Thus, a thermal image transfer recording medium No. 1-9 according to the present invention was obtained.

The diameter of each of the craters formed in the resin layer was about 3 μm, and the number of craters was about 100 per 400 $\mu m^2$ on the resin layer.

EXAMPLE 1-10

The procedure for the preparation of the thermal image transfer recording medium No. 1-6 in Example 1-6 was repeated except that the coating liquid for the resin layer used in Example 1-6 was replaced by a coating liquid with the following formulation:

| (Formulation for Coating Liquid for Resin Layer) | Parts by Weight |
|---|---|
| Cellulose acetate propionate | 3 |
| Aqueous dispersion of carnauba wax (solid content: 30 wt. %, average particle diameter: approx. 4 μm) | 8 |
| Methyl ethyl ketone | 85 |
| Methanol | 4 |

Thus, a thermal image transfer recording medium No. 1-10 according to the present invention was obtained.

The diameter of each of the craters formed in the resin layer was about 3 μm, and the number of craters was about 120 per 400 $\mu m^2$ on the resin layer. In addition, the number of penetrating holes formed in the resin layer was about 30 per 400 $\mu m^2$ on the resin layer.

Comparative Example 1-1

The procedure for the preparation of the thermal image transfer recording medium No. 1-1 in Example 1-1 was repeated except that the humidity of the air was changed from 30 to 10%RH at the drying process in the formation of the resin layer in Example 1-1, so that a comparative thermal image transfer recording medium No. 1-1 was obtained.

Neither craters nor penetrating holes were observed in the resin layer of the obtained comparative recording medium No. 1-1.

Comparative Example 1-2

The procedure for the preparation of the thermal image transfer recording medium No. 1-4 in Example 1-4, was repeated except that the humidity and the temperature of the air were respectively changed to 90%RH and 10° C. at the drying process in the formation of the resin layer in Example 1-4, so that a comparative thermal image transfer recording medium No. 1-2 was obtained.

In the resin layer of the obtained comparative thermal image transfer recording medium No. 1-2, some penetrating holes were partially broken to decrease the mechanical strength of the resin layer.

Each of the above prepared thermal image transfer recording media Nos. 1-1 to 1-10 according to the present invention and comparative thermal image transfer recording media Nos. 1-1 and 1-2 was placed in a line thermal printer, and images were transferred five times to an image receiving sheet from the same portion of the recording medium under the following conditions:

Thermal head: thin-film head type (8 dot/mm)

Platen pressure: 330 gf/cm

Peeling angle against image receiving sheet: 45°

Energy applied from thermal head: 18 mJ/mm$^2$, 15 mJ/mm$^2$

Printing speed: 4 inch/sec

Image receiving coated paper with an absorption of sheet: 4.00 ml with respect to first-class liquid paraffin in accordance with Bristow's method as defined in J.TAPPI No. 51, and a smoothness of 2,000 sec in terms of Bekk's smoothness.

Printing pattern: (a) CODE 39 parallel bar code (Narrow bar code is printed with a thickness of 2 dot by a thermal head of 8 dot/mm.) (b) Four solid black portions with an area of 6 mm by 7 mm.

Environmental conditions: 20° C., 60%RH

In the above thermal image transfer test, the following items were evaluated:

(1) Image density

The image density of the solid black portions obtained by each time of 1st, 2nd, 3rd, 4th and 5th printings was measured by a McBeth densitometer RD-914.

(2) Complete exfoliation of ink layers

The occurrence of complete exfoliation of ink layers from the support was evaluated by visual inspection.

(3) Resolution of obtained images

It was observed by visual inspection whether white non-printed spots were present in the bar code images of Code 39 parallel bar code.

In addition to the above, the occurrence of blocking phenomenon was checked by the following method:

(4) Blocking phenomenon

Each of the thermal image transfer recording media was folded and stored in such a fashion that the PET film of the upper portion was brought into contact with the resin layer of the lower portion of the recording medium, and allowed to stand at 50° C. for 24 hours with the application of a load of 2 kg/cm$^2$ thereto. After the storage of 24 hours, the recording medium was cooled to room temperature and the occurrence of the blocking phenomenon was confirmed by visual inspection.

The results are shown in Tables 1 to 3.

TABLE 1

| | Image Density | | | | |
|---|---|---|---|---|---|
| | 1st | 2nd | 3rd | 4th | 5th |
| Ex. 1-1 | 1.00 | 1.02 | 0.98 | 0.96 | 0.92 |
| Ex. 1-2 | 1.34 | 1.36 | 1.12 | 0.84 | 0.63 |
| Ex. 1-3 | 1.12 | 1.16 | 1.11 | 1.08 | 1.04 |
| Ex. 1-4 | 0.97 | 0.94 | 0.92 | 0.87 | 0.80 |
| Ex. 1-5 | 1.30 | 1.33 | 1.10 | 0.91 | 0.70 |
| Ex. 1-6 | 1.19 | 1.24 | 1.16 | 1.10 | 1.05 |
| Ex. 1-7 | 1.10 | 1.13 | 1.08 | 1.04 | 1.00 |
| Ex. 1-8 | 1.13 | 1.15 | 1.10 | 1.06 | 1.03 |
| Ex. 1-9 | 1.16 | 1.20 | 1.14 | 1.10 | 1.07 |
| Ex. 1-10 | 1.20 | 1.25 | 1.17 | 1.10 | 1.04 |
| Comp. Ex. 1-1 | 0.41 | 0.39 | 0.38 | 0.38 | 0.35 |
| Comp. Ex. 1-2 | 1.35 | 1.37 | 1.00 | 0.61 | 0.30 |

(Note): The thermal energy applied to the recording medium from the thermal head was 18 mJ/mm$^2$ in this thermal image transfer test.

TABLE 2

| | Image Density | | | | |
|---|---|---|---|---|---|
| | 1st | 2nd | 3rd | 4th | 5th |
| Ex. 1-1 | 0.92 | 0.94 | 0.90 | 0.86 | 0.82 |
| Ex. 1-2 | 1.24 | 1.26 | 1.00 | 0.79 | 0.60 |
| Ex. 1-3 | 1.04 | 1.06 | 1.00 | 0.98 | 0.94 |
| Ex. 1-4 | 0.89 | 0.84 | 0.81 | 0.77 | 0.70 |
| Ex. 1-5 | 1.22 | 1.25 | 1.02 | 0.83 | 0.63 |
| Ex. 1-6 | 1.18 | 1.23 | 1.14 | 1.08 | 1.02 |
| Ex. 1-7 | 1.02 | 1.05 | 1.00 | 0.96 | 0.91 |
| Ex. 1-8 | 1.04 | 1.06 | 1.00 | 0.95 | 0.91 |
| Ex. 1-9 | 1.06 | 1.09 | 1.04 | 1.00 | 0.97 |
| Ex. 1-10 | 1.18 | 1.22 | 1.18 | 1.11 | 1.07 |
| Comp. Ex. 1-1 | 0.37 | 0.38 | 0.37 | 0.36 | 0.33 |
| Comp. Ex. 1-2 | 1.28 | 1.32 | 1.07 | 0.60 | 0.34 |

(Note): The thermal energy applied to the recording medium from the thermal head was 15 mJ/mm$^2$ in this thermal image transfer test.

TABLE 3

| | Complete Exfoliation of Ink Layers | Resolution of Obtained Images | Occurrence of Blocking Phenomenon |
|---|---|---|---|
| Ex. 1-1 | Δ | Δ | Δ |
| Ex. 1-2 | Δ | Δ | Δ |
| Ex. 1-3 | Δ | Δ | Δ |
| Ex. 1-4 | Δ | Δ | Δ |
| Ex. 1-5 | Δ | Δ | Δ |
| Ex. 1-6 | Δ | Δ | Δ |
| Ex. 1-7 | ○ | Δ | Δ |
| Ex. 1-8 | ○ | ○ | X |
| Ex. 1-9 | ○ | ○ | ○ |
| Ex. 1-10 | ○ | ○ | ○ |
| Comp. Ex. 1-1 | Δ | X | Δ |
| Comp. | X | Δ | Δ |

TABLE 3-continued

| | Complete Exfoliation of Ink Layers | Resolution of Obtained Images | Occurrence of Blocking Phenomenon |
|---|---|---|---|
| Ex. 1-2 | | | |

Complete exfoliation of ink layers:
○: No complete exfoliation of the ink layers was observed.
Δ: Complete exfoliation of the ink layers was partially observed.
X: Complete exfoliation of the ink layers was observed at many portions.
Resolution of obtained images:
○: No white non-printed spots were observed in the bar code images.
Δ: White non-printed spots were slightly observed in the bar code images.
X: White non-printed spots were markedly observed in the bar code images.
Occurrence of blocking phenomenon:
○: No blocking phenomenon was observed.
Δ: The blocking phenomenon was partially observed.
X: The blocking phenomenon was striking.

As shown in Tables 1 and 2, the image density of the bar code images is relatively high even at the 5th printing operation, and the reproducibility of the bar code images is regarded as excellent when the thermal image transfer recording media Nos. 1-1 to 1-10 according to the present invention are employed. In particular, when the thermal image transfer recording media Nos. 1-7 to 1-10 are employed, the quality of the printed bar code images is excellent because of no exfoliation of the ink layers. Further, the thermal image transfer recording media Nos. 1-9 and 1-10 are very useful and practical because the bar code images are transferred to the image receiving sheet with excellent reproducibility and high resolution, free from the complete exfoliation of the ink layers, and in addition to the above, the resistance to the blocking phenomenon is high.

Furthermore, when the thermal energy applied to the recording medium is as low as 15 mJ/mm$^2$, the decrease in image density is remarkably small, so that multi-printing operation can be carried out in a stable condition using the thermal image transfer recording media according to the present invention.

In contrast to this, the image density of the bar code images transferred from the comparative thermal image transfer recording medium No. 1-1 is considerably low from the 1st printing operation. When the comparative thermal image transfer recording medium No. 1-2 is employed, the image density of the bar code images is drastically decreased from the 4th printing operation, so that this recording medium is not suitable for the multi-printing operation.

EXAMPLE 2-1

Formation of Thermofusible Ink Layers A and B

The following components were thoroughly dispersed in a sand mill vessel at 110° C. to prepare a coating liquid for a thermofusible ink layer A:

| | Parts by weight |
|---|---|
| Carbon black | 15 |
| Hydrous lanolin fatty acid monoglyceride (m.p. = 73° C.) | 25 |
| Candelilla wax | 20 |
| Microcrystalline wax (m.p. = 83° C.) | 30 |
| Ethylene-vinyl acetate copolymer (melt flow rate: 2,000 g/10 min) | 10 |

The thus prepared coating liquid for the thermofusible ink layer A was coated by hot-melt coating on one side of an about 5.5 μm thick PET film serving as a support in a deposition amount of about 3 g/m$^2$ on a dry basis, the other side of which PET film has been subjected to heat-resistant treatment. Thus, a thermofusible ink layer A was provided on the support.

The following components were thoroughly dispersed in a sand mill vessel at 110° C.:

| | Parts by weight |
|---|---|
| Carbon black | 10 |
| Candelilla wax | 40 |
| Hydrous lanolin fatty acid monoglyceride (m.p. = 73° C.) | 45 |
| Ethylene-vinyl acetate copolymer (melt flow rate: 400 g/10 min) | 5 |

Twenty parts by weight of the above prepared dispersion were pulverized and added to 80 parts by weight of a mixed solvent of methyl ethyl ketone and toluene with a weight ratio of 2:1. The mixture was dissolved under the application of heat thereto, and then cooled to 25° C., so that a coating dispersion for a thermofusible ink layer B was obtained.

The thus prepared coating dispersion for the thermofusible ink layer B was coated on the above prepared thermofusible ink layer A by a bar coater and then dried at 80° C., so that a thermofusible ink layer B was provided in a deposition amount of about 4 g/m$^2$ on a dry basis on the thermofusible ink layer A.

Formation of Resin Layer

The following components were mixed to prepare a coating liquid for a resin layer:

| | Parts by Weight |
|---|---|
| Vinyl chloride-vinyl acetate copolymer | 3 |
| Methyl ethyl ketone | 94 |
| Water | 3 |

The thus prepared coating liquid for the resin layer was coated on the above prepared thermofusible ink layer B by a bar coater, and then dried in such a manner that the air of 50%RH and 20° C. was uniformly applied to the resin layer coating liquid at a speed of 2 m/sec for 10 seconds. Thus, a resin layer was provided on the thermofusible ink layer B in a deposition amount of 0.2 g/m$^2$ on a dry basis.

Thus, a thermal image transfer recording medium No. 2-1 according to the present invention was obtained.

The cross section of the thermal image transfer recording medium No. 2-1 was analyzed using a TEM photograph, and the surface profile thereof was analyzed by using an SEM photograph. It was confirmed that the resin layer formed on the thermofusible ink layer B had a network structure, with cylindrical holes penetrating to the surface of the thermofusible ink layer B being formed in the network resin structure. The diameter of each penetrating hole was about 1.5 μm, the distance between the adjacent holes was about 2 μm, and the number of penetrating holes was about 150 per 400 μm$^2$ on the resin layer.

EXAMPLE 2-2

The procedure for the preparation of the thermal image transfer recording medium No. 2-1 in Example 2-1 was repeated except that the humidity of the air was changed from 50 to 80%RH at the drying process in the formation of the resin layer in Example 2-1, so that a thermal image transfer recording medium No. 2-2 according to the present invention was obtained.

The diameter of each of the penetrating holes formed in the resin layer with a network structure was about 3.0 μm, the distance between the adjacent penetrating holes was about 3 μm, and the number of penetrating holes was about 100 per 400 $\mu m^2$ on the resin layer.

EXAMPLE 2-3

The procedure for the preparation of the thermal image transfer recording medium No. 2-1 in Example 2-1 was repeated except that the coating liquid for the resin layer used in Example 2-1 was replaced by a coating liquid with the following formulation:

| (Formulation for Coating Liquid for Resin Layer) | Parts by Weight |
|---|---|
| Vinyl chloride-vinyl acetate copolymer | 3 |
| Methyl ethyl ketone | 94 |
| Methanol | 2 |
| Water | 1 |

Thus, a thermal image transfer recording medium No. 2-3 according to the present invention was obtained.

The diameter of each of the penetrating holes formed in the resin layer with a network structure was about 2.5 μm, the distance between the adjacent penetrating holes was about 4 μm, and the number of penetrating holes was about 25 per 400 $\mu m^2$ on the resin layer.

EXAMPLE 2-4

The procedure for the preparation of the thermal image transfer recording medium No. 2-3 in Example 2-3 was repeated except that the humidity and the temperature of the air were respectively changed to 80%RH and 10° C. at the drying process in the formation of the resin layer in Example 2-3, so that a thermal image transfer recording medium No. 2-4 according to the present invention was obtained.

The diameter of each of the penetrating holes formed in the resin layer with a network structure was about 2.5 μm, the distance between the adjacent penetrating holes was about 1 μm, and the number of penetrating holes was about 300 per 400 $\mu m^2$ on the resin layer.

EXAMPLE 2-5

Two thermofusible ink layers A and B were provided on a support in the same manner as in Example 2-1.

The following components were mixed to prepare a coating liquid for a resin layer:

| | Parts by Weight |
|---|---|
| Vinyl chloride-vinyl acetate copolymer | 3 |
| Calcium carbonate "Whiton SB" (Trademark), made by Shiraishi Kogyo Kaisha, Ltd., with an average particle diameter of approx. 4.0 μm | 2 |
| Methyl ethyl ketone | 92 |
| Water | 3 |

The thus prepared coating liquid for the resin layer was coated on the above prepared thermofusible ink layer B by a bar coater, and then dried in such a manner that the air of 80%RH and 20° C. was uniformly applied to the resin layer coating liquid at a speed of 2 m/sec for 10 seconds. Thus, a resin layer was provided on the thermofusible ink layer B. The resin layer constituted a network structure with holes penetrating to the surface of the thermofusible ink layer B.

Thus, a thermal image transfer recording medium No. 2-5 according to the present invention was obtained.

The diameter of each of the penetrating holes formed in the resin layer with a network structure was about 2.0 μm, the distance between the adjacent penetrating holes was about 3 μm, and the number of penetrating holes was about 80 per 400 $\mu m^2$ on the resin layer.

EXAMPLE 2-6

Two thermofusible ink layers A and B were provided on a support in the same manner as in Example 2-1.

The following components were mixed to prepare a coating liquid for a resin layer:

| (Formulation for Coating Liquid for Resin Layer) | Parts by Weight |
|---|---|
| Vinyl chloride-vinyl acetate copolymer | 3 |
| Aqueous dispersion of paraffin wax (solid content: 30 wt. %, average particle diameter: approx. 3 μm) | 8 |
| Methyl ethyl ketone | 89 |

The thus prepared coating liquid for the resin layer was coated on the above prepared thermofusible ink layer B by a bar coater, and then dried in such a manner that the air of 80%RH and 20° C. was uniformly applied to the resin layer coating liquid at a speed of 2 m/sec for 10 seconds. Thus, a resin layer was provided on the thermofusible ink layer B. The resin layer constituted a network structure with holes penetrating to the surface of the thermofusible ink layer B.

Thus, a thermal image transfer recording medium No. 2-6 according to the present invention was obtained.

The diameter of each of the penetrating holes formed in the resin layer with a network structure was about 2.0 μm, the distance between the adjacent penetrating holes was about 2 μm, and the number of penetrating holes was about 100 per 400 $\mu m^2$ on the resin layer.

EXAMPLE 2-7

Two thermofusible ink layers A and B were provided on a support in the same manner as in Example 2-1.

The following components were mixed to prepare a coating liquid for a resin layer:

| (Formulation for Coating Liquid for Resin Layer) | Parts by Weight |
|---|---|
| Vinyl chloride-vinyl acetate copolymer | 3 |
| Aqueous dispersion of carnauba wax (solid content: 30 wt. %, average particle diameter: approx. 4 μm) | 8 |
| Methyl ethyl ketone | 87 |
| Methanol | 2 |

The thus prepared coating liquid for the resin layer was coated on the above prepared thermofusible ink layer B by a bar coater, and then dried in such a manner that the air of 80%RH and 20° C. was uniformly applied to the resin layer coating liquid at a speed of 2 m/sec for 10 seconds. Thus, a resin layer was provided on the thermofusible ink layer B. The resin layer constituted a network structure with holes penetrating to the surface of the thermofusible ink layer B.

Thus, a thermal image transfer recording medium No. 2-7 according to the present invention was obtained.

The diameter of each of the penetrating holes formed in the resin layer with a network structure was about 2.0 μm, the distance between the adjacent penetrating holes was about 2 μm, and the number of penetrating holes was about 120 per 400 $\mu m^2$ on the resin layer.

Comparative Example 2-1

The procedure for the preparation of the thermal image transfer recording medium No. 2-1 in Example 2-1 was repeated except that the humidity of the air was changed from 50 to 10%RH at the drying process in the formation of the resin layer in Example 2-1, so that a comparative thermal image transfer recording medium No. 2-1 was obtained.

The network structure with penetrating holes was not observed in the obtained resin layer.

Comparative Example 2-2

Two thermofusible ink layers A and B were provided on a support in the same manner as in Example 2-1.

The following components were mixed to prepare a coating liquid for a resin layer:

| (Formulation for Coating Liquid for Resin Layer) | Parts by Weight |
|---|---|
| Vinyl chloride-vinyl acetate copolymer | 3 |
| Methyl ethyl ketone | 74 |
| Methanol | 20 |
| Water | 3 |

The thus prepared coating liquid for the resin layer was coated on the above prepared thermofusible ink layer B by a bar coater, and then dried in such a manner that the air of 90%RH and 20° C. was uniformly applied to the resin layer coating liquid at a speed of 2 m/sec for 10 seconds, so that a resin layer was provided on the thermofusible ink layer B.

Thus, a comparative thermal image transfer recording medium No. 2-2 was obtained.

In the resin layer of the comparative thermal image transfer recording medium No. 2-2, some penetrating holes were partially broken to decrease the mechanical strength of the resin layer.

By placing each of the above prepared thermal image transfer recording media Nos. 2-1 to 2-7 according to the present invention and comparative thermal image transfer recording media Nos. 2-1 and 2-2 in the same line thermal printer as previously employed, the same thermal image transfer test was carried out under the same conditions as mentioned above.

The image density, the complete exfoliation of the ink layers, the resolution of the obtained images, and the occurrence of the blocking phenomenon were evaluated in the same manner as previously explained.

The results are shown in Tables 4 and 5.

TABLE 4

| | Image Density | | | | |
|---|---|---|---|---|---|
| | 1st | 2nd | 3rd | 4th | 5th |
| Ex. 2-1 | 1.14 | 1.16 | 1.07 | 1.00 | 0.95 |
| Ex. 2-2 | 1.22 | 1.25 | 1.17 | 1.14 | 1.09 |
| Ex. 2-3 | 1.02 | 1.08 | 0.98 | 0.92 | 0.88 |
| Ex. 2-4 | 1.27 | 1.31 | 1.24 | 1.11 | 1.05 |
| Ex. 2-5 | 1.20 | 1.24 | 1.12 | 1.09 | 1.03 |
| Ex. 2-6 | 1.23 | 1.27 | 1.19 | 1.14 | 1.09 |
| Ex. 2-7 | 1.26 | 1.30 | 1.21 | 1.13 | 1.11 |
| Comp. Ex. 2-1 | 0.38 | 0.35 | 0.31 | 0.29 | 0.29 |
| Comp. Ex. 2-2 | 1.36 | 1.38 | 1.02 | 0.51 | 0.22 |

(Note): The thermal energy applied to the recording medium from the thermal head was 18 $mJ/mm^2$.

TABLE 5

| | Complete Exfoliation of Ink Layers | Resolution of Obtained Images | Occurrence of Blocking Phenomenon |
|---|---|---|---|
| Ex. 2-1 | Δ | Δ | Δ |
| Ex. 2-2 | Δ | ○ | Δ |
| Ex. 2-3 | Δ | ○ | Δ |
| Ex. 2-4 | Δ | ○ | Δ |
| Ex. 2-5 | ○ | ○ | Δ |
| Ex. 2-6 | ○ | ○ | X |
| Ex. 2-7 | ○ | ○ | ○ |
| Comp. Ex. 2-1 | Δ | ○ | Δ |
| Comp. Ex. 2-2 | X | ○ | Δ |

Complete exfoliation of ink layers:
○: No complete exfoliation of the ink layers was observed.
Δ: Complete exfoliation of the ink layers was partially observed.
X: Complete exfoliation of the ink layers was observed at many portions.
Resolution of obtained images:
○: No white non-printed spots were observed in the bar code images.
Δ: White non-printed spots were slightly observed in the bar code images.
X: White non-printed spots were markedly observed in the bar code images.
Occurrence of blocking phenomenon:
○: No blocking phenomenon was observed.
Δ: The blocking phenomenon was partially observed.
X: The blocking phenomenon was striking.

As shown in Tables 4 and 5, the image density of the bar code images is relatively high even at the 5th printing operation, and the bar code images are produced with high reproducibility when the thermal image transfer recording media Nos. 2-1 to 2-7 according to the present invention are employed. Further, the image quality of the images printed by using the thermal image transfer recording media Nos. 2-5 to 2-7 is excellent because the reproducibility of the images is high and the image density is even. In particular, the thermal image transfer recording medium No. 2-7 is regarded as very useful and practical because of excellent multi-printing properties and high blocking resistance.

In contrast to this, the image density of the bar code images transferred from the comparative thermal image transfer recording medium No. 2-1 is considerably low from the 1st printing operation. When the comparative thermal image transfer recording medium No. 2-2 is employed, the image density of the bar code images is drastically decreased from the 4th printing operation, so that this recording medium is not suitable for the multi-printing operation.

As previously explained, when the thermal image transfer recording medium of the present invention is employed for thermal printing, the multi-printing properties of the thermal image transfer recording medium are improved because the exfoliation of the ink layer from the support can be prevented and the amount of the ink oozing from the ink layer can be controlled. This is because the thermal image transfer recording medium of the present invention comprises a thermofusible ink layer and a resin layer formed thereon, which has a structure with minute craters thereon. Furthermore, in the case where not only the craters, but also the holes penetrating to the surface of the thermofusible ink layer are formed in the resin layer of the recording medium according to the present invention, sharp images with high image density can be formed on the image receiving medium even if the thermal energy applied to the recording medium from the thermal head is small. In the present invention, the resin layer may constitute a network structure with holes passing therethrough and penetrating to the surface of the thermofusible ink layer.

When the coating amount of the resin layer is in the range from 0.02 to 0.50 g/m$^2$ in the thermal image transfer recording medium according to the present invention, the amount of the ink oozing from the ink layer can be well controlled.

The multi-printing operation can be accomplished with high image density being maintained when the diameter of each crater is in the range from 0.01 to 10 μm, and the number of craters formed in the resin layer is in the range from 30 to 300 per 400 μm.

Further, the complete transfer of the ink layer to the image receiving sheet can be prevented when the releasing agent is contained in the resin layer or deposited thereon in the form of granules. In addition, when the releasing agent to be employed in the resin layer comprises a wax as the main component, the transferred images have excellent resolution, with white non-printed spots extremely reduced in a black solid area. Furthermore, when the wax with a penetration of 2 or less at 25° C. is used for the releasing agent, the resistance to the blocking phenomenon can be improved.

What is claimed is:

1. A thermal image transfer recording medium comprising a support, a thermofusible ink layer formed thereon, which thermofusible ink layer comprises a thermofusible material and a coloring agent, and a resin layer formed on said thermofusible ink layer, which resin layer has minute craters therein.

2. The thermal image transfer recording medium as claimed in claim 1, wherein holes penetrating to the surface of said thermofusible ink layer are formed in said resin layer.

3. The thermal image transfer recording medium as claimed in claim 1, wherein said resin layer comprises a thermoplastic resin selected from the group consisting of vinyl chloride—vinyl acetate copolymer, polyester resin, polycarbonate resin and cellulose resin.

4. The thermal image transfer recording medium as claimed in claim 3, wherein the coating amount of said thermoplastic resin for use in said resin layer is in the range from 0.02 to 0.50 g/m$^2$ on a dry basis.

5. The thermal image transfer recording medium as claimed in claim 1, wherein each of said craters formed in said resin layer has a diameter of 0.01 to 10 μm.

6. The thermal image transfer recording medium as claimed in claim 1, wherein the number of craters is in the range from 30 to 300 per 400 μm$^2$ on said resin layer.

7. The thermal image transfer recording medium as claimed in claim 1, wherein said resin layer further comprises a releasing agent which is contained in said resin layer or deposited thereon in the form of granules.

8. The thermal image transfer recording medium as claimed in claim 7, wherein said releasing agent comprises a wax.

9. The thermal image transfer recording medium as claimed in claim 8, wherein said wax in said releasing agent has a penetration of 2 or less at 25° C.

* * * * *